US005407098A

United States Patent [19]

Tomer

[11] Patent Number: 5,407,098

[45] Date of Patent: Apr. 18, 1995

[54] CONTAINER-MOUNTED SOLID DISK FLUID POURING AID

[76] Inventor: Rex F. Tomer, P.O. Box 205, Benton, Ill. 62812

[21] Appl. No.: 147,665

[22] Filed: Nov. 3, 1993

[51] Int. Cl.[6] ..... B67B 7/00

[52] U.S. Cl. ..... 222/1; 222/153.06; 222/543; 222/545; 220/375

[58] Field of Search ..... 222/153, 543, 545, 1; 220/375, 715; 215/235, 252; 251/120

[56] References Cited

U.S. PATENT DOCUMENTS

| | | | |
|---|---|---|---|
| 2,527,191 | 10/1950 | Lambert | 222/543 X |
| 3,117,701 | 1/1964 | Stull | 222/543 |
| 3,307,752 | 3/1967 | Anderson | 222/543 X |
| 4,054,221 | 10/1977 | Glover | 215/235 |
| 4,203,524 | 5/1980 | Wieland | 215/216 |
| 4,938,390 | 7/1990 | Markva | 222/545 X |
| 5,008,066 | 4/1991 | Mueller | 264/537 |
| 5,102,002 | 4/1992 | Whitley | 220/375 X |

*Primary Examiner*—Gregory L. Huson
*Attorney, Agent, or Firm*—John R. Flanagan

[57] ABSTRACT

A fluid pouring aid includes a substantially flat solid imperforate disk being larger in size than a dispensing opening of a container with which the aid is to be used and an interconnecting structure attached to the solid flat disk for releasably interconnecting the disk to the container. To use the pouring aid, a user holds the container with one hand and uses the index finger to place and hold the solid flat disk in an contacting position overlying and closing the dispensing opening of the container such that flow of fluid from the container is blocked as the container is moved from an upright position to a tipped pouring position. Once at the tipped pouring position, the user moves the index finger and slides the solid flat disk laterally relative to the dispensing opening of the container to unblock the opening and allow flow of fluid directly from the container into a fluid reservoir without risk of spilling.

17 Claims, 3 Drawing Sheets

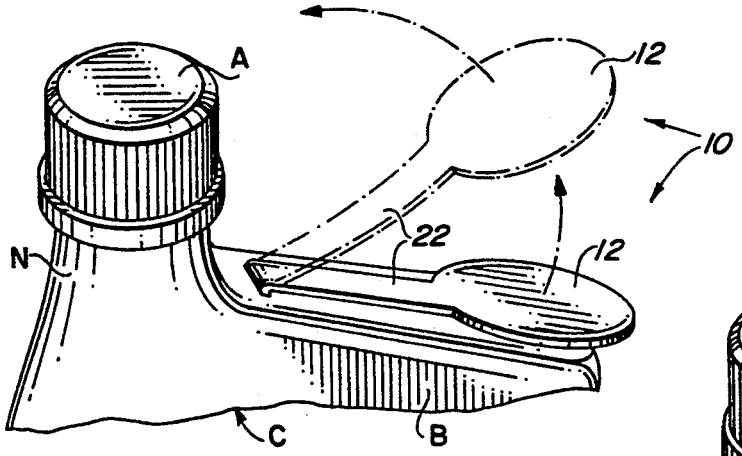
FIG. 9
FIG. 10
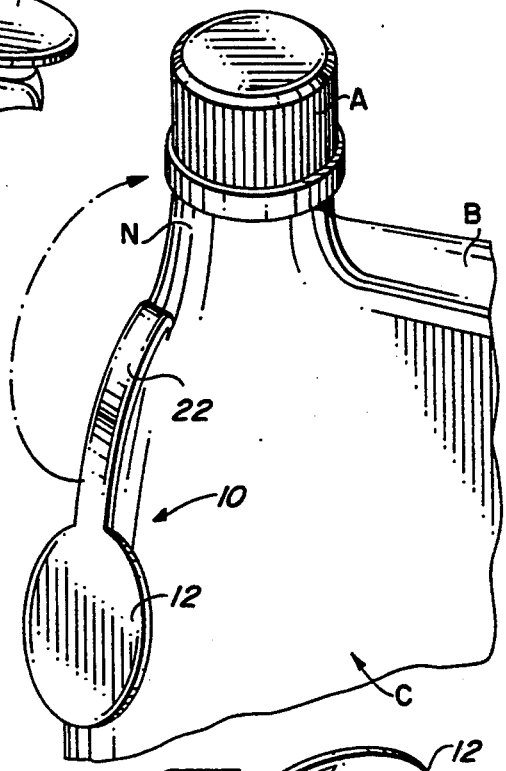
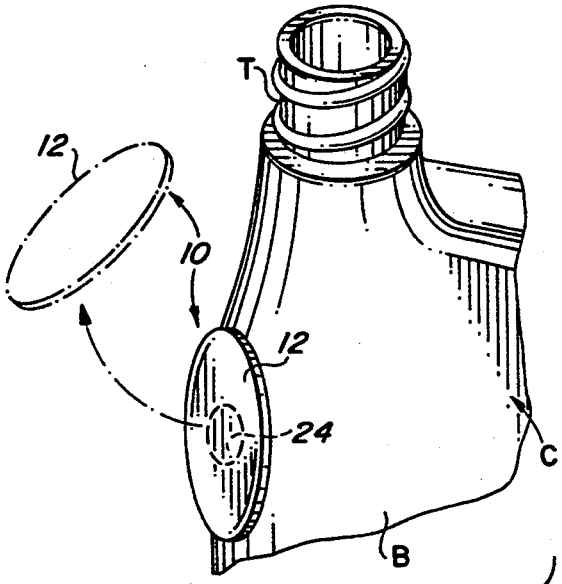
FIG. 11
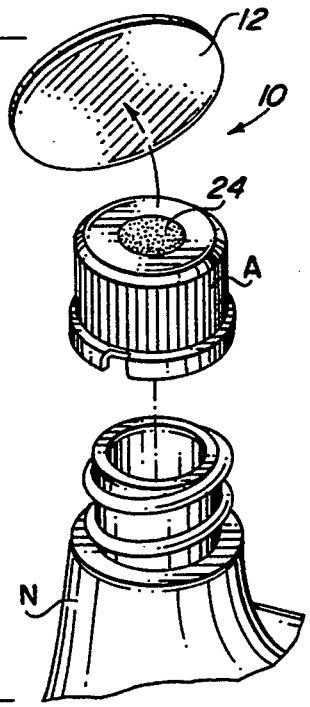
FIG. 13
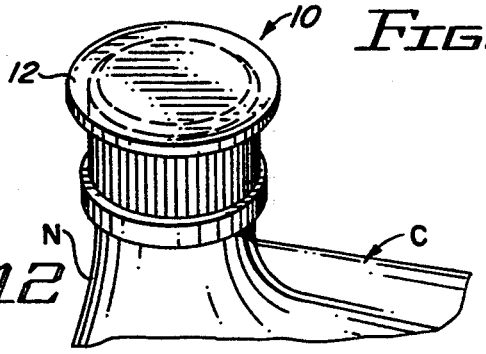
FIG. 12

CONTAINER-MOUNTED SOLID DISK FLUID POURING AID

BACKGROUND OF THE INVENTION

1. Field of the Invention

The present invention generally relates to pouring of fluids, such as oil, anti-freeze, windshield cleaner, etc., from containers into an inlet opening of a fluid reservoir and, more particularly, is concerned with a solid disk fluid pouring aid mounted on the fluid container and a method of using the pouring aid.

2. Description of the Prior Art

Most people who have added fluids, such as oil, anti-freeze and windshield cleaner, to the relatively small inlet orifices of fluid reserviors in vehicles have experienced inadvertent spills during the act of tipping the container from an upright position to a tilted pouring position. Without the use of a funnel, plastic containers which hold these fluids are difficult to pour fluids from. This is due to the closeness of the components in the engine compartment of a vehicle, which makes it is impossible to place the dispensing opening of the pouring spout of the containers near to the reservoir inlet orifice while the container is upright. As a result, the fluid starts to pour out of the container spout dispensing opening before the inlet orifice is reached. The spilled fluid ends upon the engine compartment components. Even if a funnel is used, fluid residue will still drip from the funnel onto the engine and ground when the funnel is removed.

Consequently, a need exists for a simple and effective way to overcome the aforementioned problems and thereby facilitate pouring of fluids into the inlet orifices of fluid reservoirs located in the cramped engine compartments of vehicles.

SUMMARY OF THE INVENTION

The present invention provides a container-mounted solid disk fluid pouring aid which is designed to satisfy the aforementioned need. The fluid pouring aid of the present invention provides a simple and effective device which facilitates pouring fluids in a spill-free manner.

Accordingly, the present invention is directed to a fluid pouring aid which comprises: (a) a substantially flat solid imperforate disk being larger in size than a dispensing opening of a container with which the aid is to be used; and (b) means attached to the disk for releasably interconnecting the disk to the container.

Several modified embodiments of the fluid pouring aid of the present invention are disclosed. In a first embodiment, the interconnecting means includes a ring adapted for insertion and attachment over the neck of the container from which the fluid is to be poured and a bendable connecting web extending between and interconnecting the ring and the solid disk. In a second embodiment, the interconnecting means is an elongated bendable connecting web extending between and interconnecting the solid disk and a portion of the body of the container. In a third embodiment, the interconnecting means is a patch of adhesive, such as glue or double face tape, attaching the solid disk on the body of the container, upon removal of the solid disk from the body of the container. The solid disk could be attached directly to the index finger of a user (by the glue or double face tape that is used to attach it to the container) or to the top or side of the cap removed from the container. The solid disk could also be permanently mounted to the top or side of the cap or to a company safety seal ring of the removable cap with or without a index finger groove provided on the cap.

The solid disk can have any one of several different configurations, such as circular and polygonal configurations. Examples of the polygonal configuration are rectangular, or square, and octagonal. Also, the disk can have a gripping feature formed thereon, such as an array of raised protuberances.

The present invention also provides a method of using the pouring aid for pouring fluid from a container having a dispensing opening. The method comprises the steps of: (a) holding in a non-pouring position a container at least partially filled with a fluid; (b) placing a disk imperforate to fluid in a contacting relation with the container and over a fluid dispensing opening thereof and retaining the disk over the opening with a finger of a hand so as to close the opening; (c) tipping the container from the non-pouring position to a pouring position while retaining the disk over the opening with the finger, maintaining the opening closed and flow of fluid blocked from the container through the opening; (d) disposing the tipped container with the closed dispensing opening adjacent to a fluid receiving inlet orifice of a reservoir; and (e) moving the finger and disk retained by the finger laterally relative to the dispensing opening D of the container such that the opening becomes at least partially unblocked and fluid in the container is allowed to flow directly from the container through the opening and into the fluid receiving inlet orifice of the reservoir.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 9 is a perspective view of a second embodiment of the fluid pouring aid shown connected to the body of the container from which the fluid is to be poured.

FIG. 10 is a perspective view of a modified form of the second embodiment of the fluid pouring aid of FIG.

FIG. 11 is a perspective view of a third embodiment of the fluid pouring aid shown connected to the body of the container from which the fluid is to be poured.

FIG. 12 is a perspective view of a modified form of the third embodiment of the fluid pouring aid shown connected to the removable cap of the container from which the fluid is to be poured.

FIG. 13 is an exploded perspective view of the fluid pouring aid of FIG. 12.

DETAILED DESCRIPTION OF THE INVENTION

Figure 1:
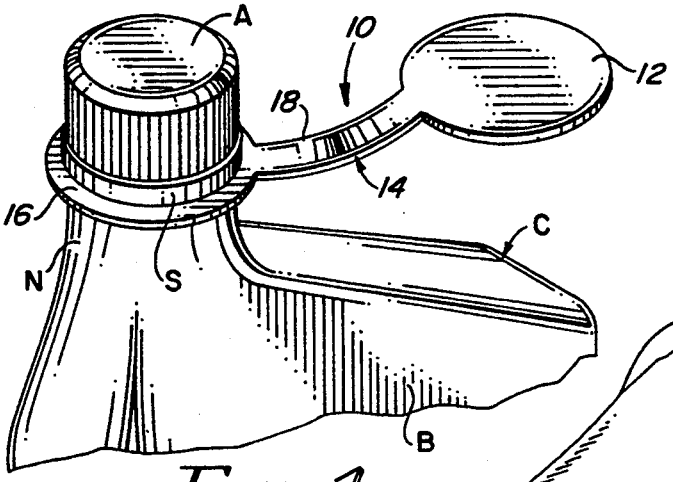
FIG. 1 is a perspective view of a first embodiment of a fluid pouring aid of the present invention shown connected to the neck of the container from which the fluid is to be poured.

Referring to the drawings and particularly to FIGS. 1 to 4, there is illustrated a first embodiment of a fluid pouring aid of the present invention, generally designated 10, mounted to a container C from which fluid is to be poured. The fluid pouring aid 10 is shown connected to the neck N of the container C adjacent to a dispensing opening D thereof from which the fluid will be poured. There are several embodiments of the pouring aid 10 disclosed herein. In all embodiments the pouring aid 10 can be made from a suitable material, such as plastic, laminated paper or cardboard.

Figure 2:
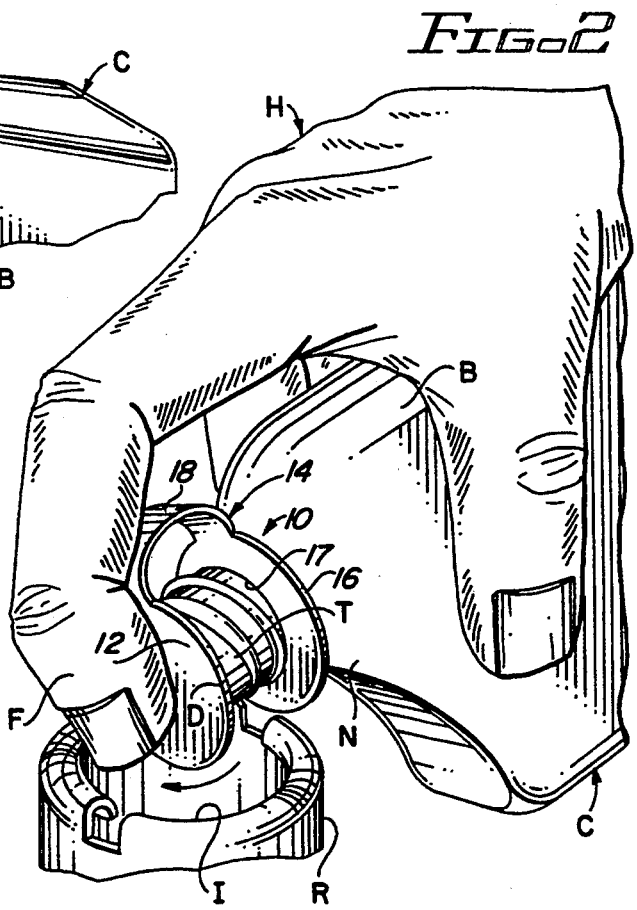
FIG. 2 is a perspective view of the fluid pouring aid of FIG. 1 showing its flat solid disk being moved laterally by the index finger to unblock fluid flow from the container.
Figure 3:
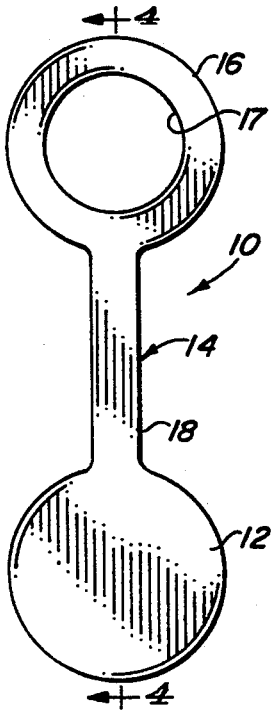
FIG. 3 is a plan view of the fluid pouring aid of FIG. 1.
Figure 4:
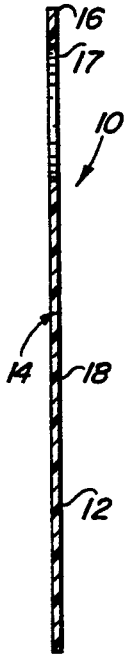
FIG. 4 is a longitudinal sectional view of the fluid pouring aid taken along line 4—4 of FIG. 3.
Figure 5:
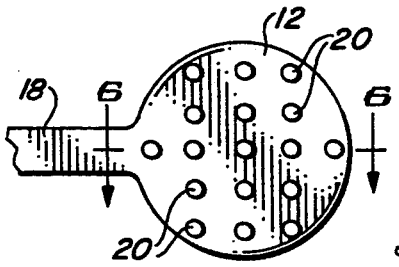
FIG. 5 is a fragmentary plan view of a modified form of the flat solid disk of the fluid pouring aid having an array of raised protuberances thereon for enhanced gripping.
Figure 7:
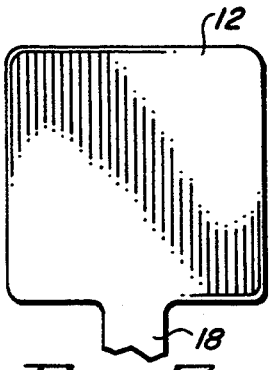
FIG. 7 is a fragmentary plan view of another modified form of the flat solid disk of the fluid pouring aid having a rectangular configuration.
Figure 8:
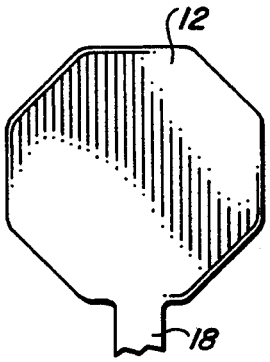
FIG. 8 is a fragmentary plan view of another modified form of the flat solid disk of the fluid pouring aid having an octagonal configuration.

Basically, in all embodiments, the fluid pouring aid 10 includes a substantially flat solid imperforate disk 12 and an interconnecting structure 14 having different forms in the different embodiments being attached to the flat solid disk 12 for releasably interconnecting the disk 12 to the container C. In all embodiments the flat disk 12 is larger in size, such as solid imperforate surface area, than the dispensing opening D of the container C so that the disk 12 can be placed over the dispensing opening D of the container C so as to close the opening D and block the flow of fluid from the container C. In FIG. 2 the fluid pouring aid 10 is show with the flat disk 12 being moved laterally by the index finger F to unblock fluid flow from the container C.

Referring to FIGS. 1-4, in the first embodiment of the fluid pouring aid 10 the interconnecting structure 14 includes a ring 16 having an opening 17 adapting the ring 16 for insertion and mounting over the neck N of the container C from which the fluid is to be poured, and an elongated bendable connecting strip 18 extending between and interconnecting edges of the ring 16 and the flat solid disk 12. The ring 16 can be provided as a part of an annular company safety seal ring S being mounted about the threaded portion T of the neck N, as presently used on conventional containers C, which remains with the container C after the cap A is twisted off the company safety seal ring S.

Figure 6:
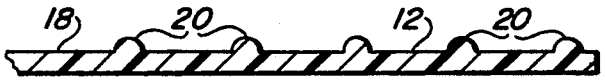
FIG. 6 is an enlarged longitudinal sectional view of the modified flat solid disk taken along line 6—6 of FIG. 5.

Referring to FIGS. 5-8, there is illustrated modified forms of the disk 12 of the pouring aid 10. In FIG. 6 the disk 12 has an array of raised protuberances 20 formed thereon which enhance the gripping of the disk 12 by the index finger F. Instead of the circular configuration shown in FIGS. 1-3, the disk 12 can have different polygonal configurations. For example, in FIG. 7 the disk 12 has a rectangular configuration, whereas in FIG. 8 the disk 12 has an octagonal configuration.

Referring to FIGS. 9 and 10, there is illustrated a second embodiment of the fluid pouring aid 10 wherein the interconnecting structure 14 is an elongated bendable strip 22 extending between the disk 12 and the container C and being attached at one end to the body B of the container C from which the fluid is to be poured. In both embodiments of FIGS. 1-4 and FIGS. 9 and 10, the elongated strip 18, 22 while bendable is sufficiently resilient so that its tendency is to straighten out. This makes it easier to use the index finger F along to apply pressure on the flat disk 12 to hold it in place or to move it laterally when desired.

Figure 14:
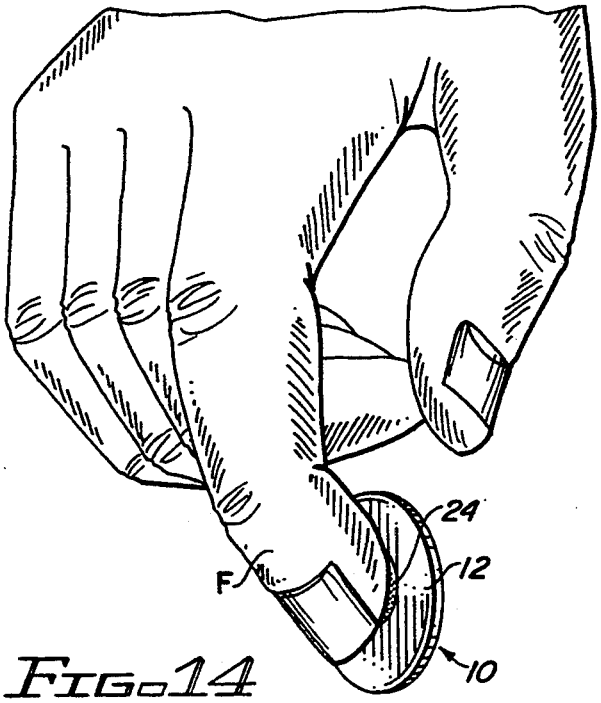
FIG. 14 is a perspective view of the fluid pouring aid of FIG. 11 showing the flat solid disk attached directly to the index finger of a user so that it can be moved laterally by the index finger to unblock fluid flow from the container.
Figure 15:
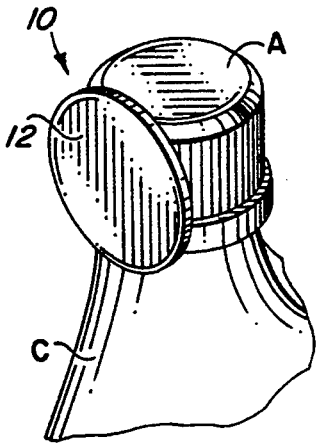
FIG. 15 is a perspective view of a modified form of the third embodiment of the fluid pouring aid shown connected to the removable cap or to the company safety seal ring of the container from which the fluid is to be poured.
Figure 17:
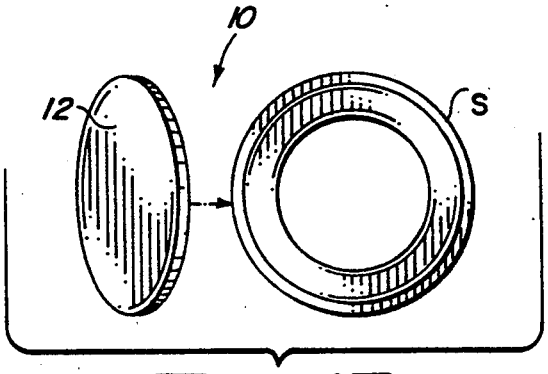
FIG. 17 is a perspective view of a modified form of the third embodiment of the fluid pouring aid shown connected to the company safety seal ring from the bottom of the removable cap of the container from which the fluid is to be poured.
Figure 16:
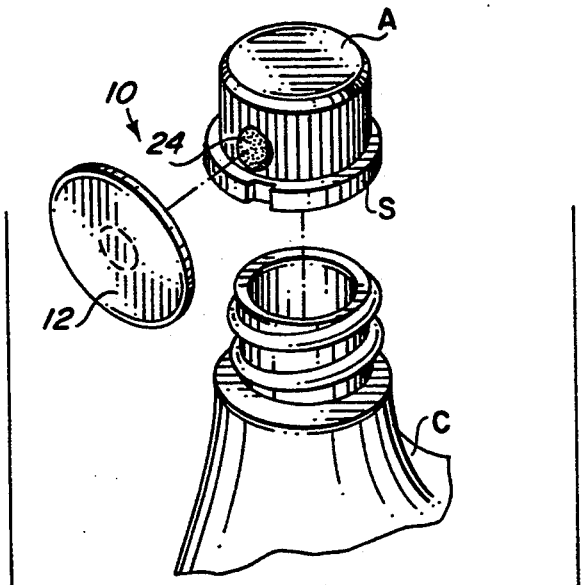
FIG. 16 is an exploded perspective view of the fluid pouring aid of FIG. 15.
Figure 18:
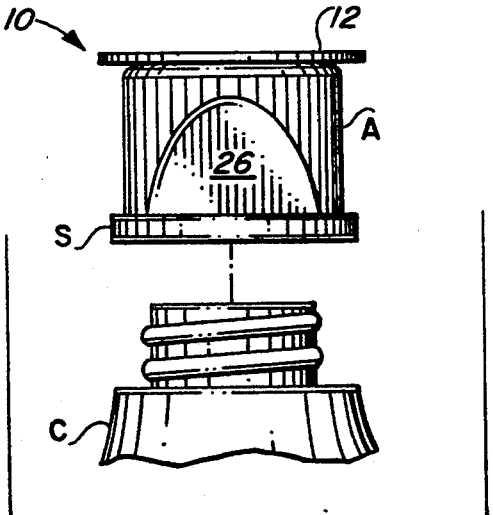
FIG. 18 is a perspective view of a modified form of the third embodiment of the fluid pouring aid shown connected to the removable cap with an index finger groove recessed in the cap of the container from which the fluid is to be poured.

Referring to FIGS. 111-18, there is illustrated a third embodiment of the fluid pouring aid 10. In the third embodiment, the interconnecting means is a patch 24 of adhesive, such as a suitable glue or a double face tape, attaching the solid disk 12 on a portion of the body B of the container C or on the top of the cap A on the container C or on the company safety seal ring S which is attached to the bottom of the cap A. In FIG. 11, the flat disk 12 is removably attached to the body B of the container C from which the fluid is to be poured. In FIGS. 12 and 13, the flat disk 12 is removably attached to the removable cap A of the container C. In FIG. 14, the flat disk 12 is stuck to the end of the index finger F of the user by the patch 24 of adhesive so that it can be moved laterally to unblock the flow of fluid from the container as shown previously in FIG. 2. In FIGS. 15 and 16, the flat disk 12 is removably attached to either a side of the cap A or to the company safety seal ring S. FIG. 17 shows the solid flat disk 12 attached to the company safety seal ring S. FIG. 18 shows a groove 26 recessed in a side of the cap A which can be used by the index finger to move the flat disk 12.

Referring again to FIGS. 1 and 2, in order to use the pouring aid 10, a user holds the container C with one hand H and uses the index finger F of the same hand H to place and hold the flat solid disk 12 in a contacting position overlying and closing the dispensing opening D of the container C such that flow of fluid from the container C is blocked as the container C is moved from an upright position, shown in FIG. 1, to a tipped pouring position, shown in FIG. 2. At the tipped position of FIG. 2, the dispensing opening D of the container C is disposed adjacent to an inlet orifice I of a fluid reservior R. The user then moves the index finger F and slides the disk 12 laterally relative to the dispensing opening D of the container C such that the dispensing opening D is now unblocked and the fluid is allowed to flow directly from the container C into the reservoir R with minimal risk of spilling.

From the above description it will be realized that the fluid pouring aid 10 can be provided either with the container C by the original manufacturer or sold as an aftermarket product which is then obtained and applied by a user.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A fluid pouring aid, comprising:

(a) a substantially flat solid imperforate disk larger in size than a dispensing opening of a container with which the aid is to be used; and (b) means attached to the solid flat disk for releasably interconnecting said disk to the container;

(c) said interconnecting means including (i) a company safety seal ring disposed over a neck of the container, and (ii) a patch of adhesive material being attached on said disk and said company safety seal ring.

2. The pouring aid of claim 1 wherein said disk has a substantially circular configuration.

3. The pouring aid of claim 1 wherein said disk has a substantially rectangular configuration.

4. The pouring aid of claim 1 wherein said disk has a substantially polygonal configuration.

5. The pouring aid of claim 1 wherein said disk has an array of raised protuberances formed thereon.

6. The pouring aid of claim 1 wherein said patch of adhesive material is a glue.

7. The pouring aid of claim 1 wherein said patch of adhesive material is a double face tape.

8. A fluid pouring aid, comprising:

(a) a substantially flat solid imperforate disk larger in size than a dispensing opening of a container with which the aid is to be used; and (b) means attached to the solid flat disk for releasably interconnecting said disk to the container;

(c) said interconnecting means including (i) a company safety seal ring disposed over a neck of the container, and (ii) a patch of adhesive material being attached on said disk and a removable cap of the container.

9. The pouring aid of claim 8 wherein said interconnecting means also includes an elongated bendable connecting strip extending between and interconnecting said disk and said company safety seal ring.

10. The pouring aid of claim 9 wherein said disk has a substantially circular configuration.

11. The pouring aid of claim 9 wherein said disk has a substantially rectangular configuration.

12. The pouring aid of claim 9 wherein said disk has a substantially polygonal configuration.

13. The pouring aid of claim 9 wherein said disk has an array of raised protuberances formed thereon.

14. The pouring aid of claim 8 wherein said patch of adhesive material is a glue.

15. The pouring aid of claim 8 wherein said patch of adhesive material is a double face tape.

16. The pouring aid of claim 8 wherein a finger receiving groove is formed in the removable cap of the container.

17. A method of pouring fluid from a container having a dispensing opening, said method comprising the steps of:

(a) holding in a non-pouring position a container at least partially filled with a fluid;

(b) placing a disk imperforate to fluid in a contacting relation with the container and over a fluid dispensing opening thereof and retaining the disk over the opening with a finger of a hand so as to close the opening;

(c) tipping the container from the non-pouring position to a pouring position while retaining the disk over the opening with the finger, maintaining the opening closed and flow of fluid blocked from the container through the opening;

(d) disposing the tipped container with the closed dispensing opening adjacent to a fluid receiving inlet orifice of a reservoir; and (e) moving the finger and disk retained by the finger laterally relative to the dispensing opening of the container such that the opening becomes at least partially unblocked and fluid in the container is allowed to flow directly from the container through the opening and into the fluid receiving inlet orifice of the reservoir.

* * * * *